United States Patent [19]

Miller

[11] 4,241,921

[45] Dec. 30, 1980

[54] BINGO CARD HOLDER

[76] Inventor: David R. Miller, 6337 Bannock Way, Las Vegas, Nev. 89107

[21] Appl. No.: 23,706

[22] Filed: Mar. 26, 1979

[51] Int. Cl.[3] ..... A63F 3/06; B42F 17/14

[52] U.S. Cl. ..... 273/148 A; 40/380; 211/11; 220/22.3

[58] Field of Search ..... 273/148 A; 40/380; 220/22.1, 22.2, 22.3; 211/11

[56] References Cited

U.S. PATENT DOCUMENTS

| | | | |
|---|---|---|---|
| 1,053,009 | 2/1913 | Carver | 40/380 |
| 1,160,104 | 11/1915 | Rodenstein | 220/22.3 |
| 1,325,537 | 12/1919 | Ringler | 220/22.3 |
| 1,338,789 | 5/1920 | Rand | 40/380 |
| 2,221,024 | 11/1940 | Hood | 220/22.3 |
| 2,371,713 | 3/1945 | Short | 220/22.1 X |
| 4,084,699 | 4/1978 | Koepke | 211/11 |

FOREIGN PATENT DOCUMENTS

| | | | |
|---|---|---|---|
| 684536 | 4/1964 | Canada | 40/380 |
| 681976 | 10/1939 | Fed. Rep. of Germany | 211/11 |

*Primary Examiner*—Anton O. Oechsle

*Attorney, Agent, or Firm*—Seiler & Quirk

[57] ABSTRACT

A container for holding a plurality of bingo cards during play has rigid front and rear flaps for supporting the cards. A plurality of transverse grooves prevent slippage of cards during play. One of the support members is adjustable along the length of the container for accomodating various numbers of cards.

3 Claims, 4 Drawing Figures

BINGO CARD HOLDER

BACKGROUND OF THE INVENTION

This invention relates to a container for supporting a plurality of bingo cards to enable a user to play a substantial number of different cards during the same game.

The game of "bingo" has been one of the world's most popular games for many decades. In addition to being played as a home or parlor game, bingo is played by large audiences in gambling casinos, and is frequently used as a fund raising event by thousands of churches and charitable institutions.

Because a player can directly increase his probabilities of winning in any particular game, many players have become proficient at a playing a substantial number of different cards during the same game. These cards are either spread out on a table in front of the player, or are stacked along a rack in side-by-side fashion, permitting the player to rapidly scan the cards each time a number is called to see if the number is present on any of the cards. Using this technique, a player can become adept at playing about eight different cards.

Other box-type apparatus have been devised in an effort to increase the number of cards which a player can play during each game. Applicant has known in the past of box-type devices in which bingo cards are stacked in front-to-back alignment for holding the cards during the play of the game. In additin, applicant is aware of a number of devices in the patent literature which have some resemblance to his bingo card holder.

A number of prior art patents exist in the filing device art. For example, Koepke, U.S. Pat. No. 4,084,699, relates to a filing unit for office use to store loose papers of the type utilized by a bookkeeper. The device consists of a shelf member having a plurality of pivotally mounted removable dividers. Zinnbauer, U.S. Pat. No. 3,897,871 provides a similar storage cabinet for print albums. Albums can be stacked longitudinally in the storage cabinet between sets of dividers. Weiss, U.S. Pat. No. 1,116,184, and Ringlar, U.S. Pat. No. 1,325,537, both disclose filing cabinets having a removable divider for retaining varying quantities of filed materials.

Kasik, U.S. Pat. No. 628,943, shows a rack useful for storing metal note-discs of the type used on old nickel-odeons. The rack has two outwardly extending end support members which hold the discs in an almost vertical position. A very similar device for holding phonograph records is shown in Blodget, U.S. Pat. No. 2,489,476.

It is an object of the present invention to provide a container for stacking a plurality of bingo cards in adjacent front-to-back parallel alignment such that a user can rapidly flip through a large number of cards to determine if a number which has been called is present on any of the cards. It is a further object of the invention to provide a bingo card holder which is adjustable to contain anywhere from a few cards to 30 or more cards. It is a further object of the invention to provide a bingo card holder having means to prevent slippage of the bottom of the cards along the holder during use.

SUMMARY OF THE INVENTION

A holder for a plurality of bingo cards comprises a container having a floor, a front wall, a rear wall, side walls, first and second card support members pivotally mounted between said side walls, adjustment means for selectively moving the position of one of said card support members along said side walls, and a series of transverse edge retaining means in said floor to prevent slippage of bingo cards along the floor.

BRIEF DESCRIPTION OF THE DRAWINGS

The invention is best understood with reference to the drawings, in which.

DETAILED DESCRIPTION OF THE INVENTION

Figure 1:
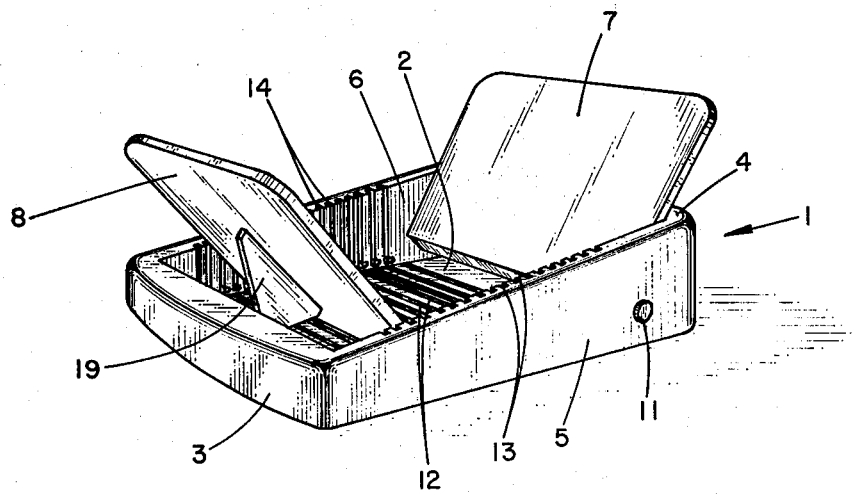
FIG. 1 is a perspective view of the bingo card holder of the invention in operating position.

Referring to FIG. 1, bingo card holder 1 is a container having a floor 2, front wall 3, back wall 4, and side walls 5 and 6. Extending outwardly and over the front wall at an obtuse angle to the inner portion of the floor is a card support member or flange 8. Extending outwardly over the rear wall at an obtuse angle to the inner portion of the floor is a similar card support member 7. The latter card support member is a flange pivotally mounted at the bottom portion between side walls 5 and 6. This member is permanently mounted in the walls by pins at either end of the bottom portion thereof; mounting pin 11 is shown in FIG. 1.

Figure 3:
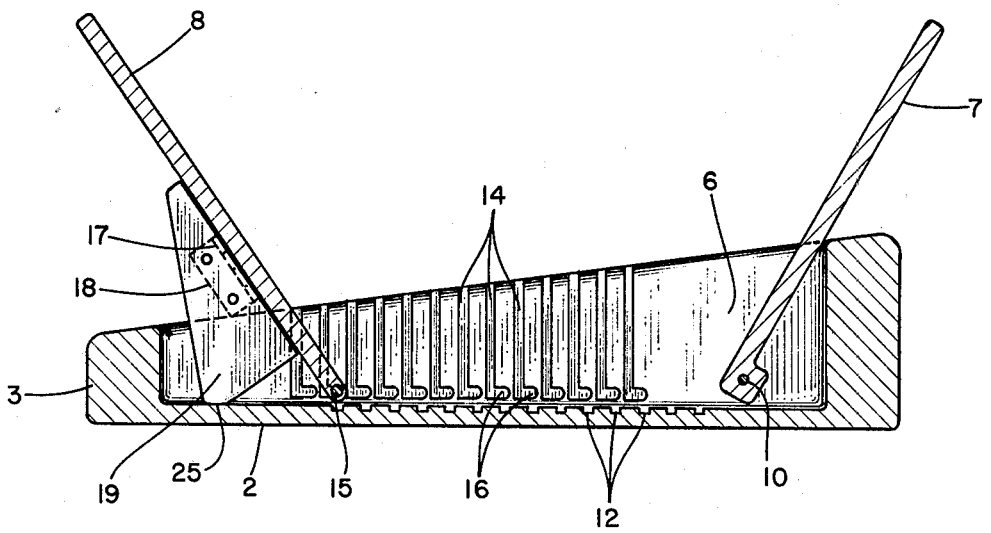
FIG. 3 is a side sectional view of the bingo card holder showing the mounting mechanism for the card support members.

Card support member 8 can be selectively relocated longitudinally along the sides of the container. A pair of mounting pins having a circular cross-section are located on opposite sides of the lower portion of the support member; mounting pin 15 is shown in FIG. 3. These pins slide into opposing slots 13 and 14 in sides 5 and 6, respectively. Horizontal legs 16 at the bottom portion of the slots prevent the card support members from sliding upwardly out of the slots when bingo cards are placed against the inner surface of the member. The slots on the two opposing sides are identical in configuration.

A series of parallel transverse grooves 12 are placed along the floor of the container to prevent substantial slippage of the cards in the device. It is not necessary for each card to set in a separate groove; indeed, it has been found that 2 or 3 cards may be retained between the cards setting in adjacent grooves without causing sufficient slippage of the cards to impair operation. The grooves are about 0.5 inches apart, and about 0.1 inches in width.

Figure 4:
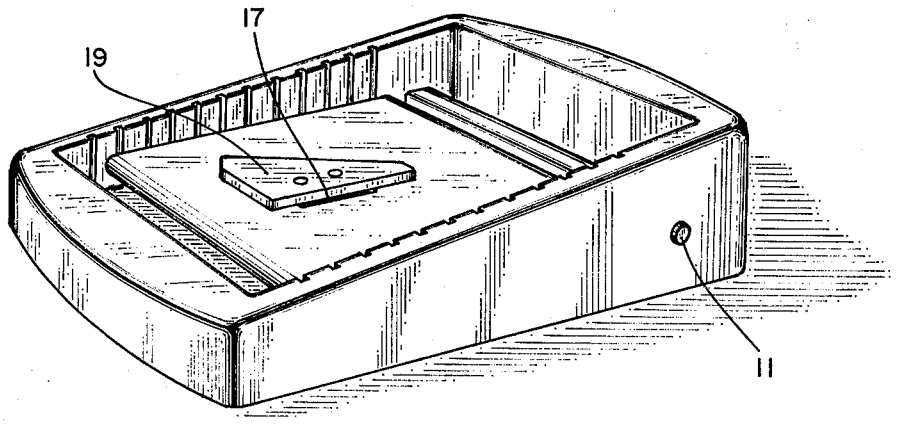
FIG. 4 is a perspective view of the apparatus with the card support members in folded position.

The adjustable card support member 8 has a hinged brace 19 attached to its rear surface. The brace consists of a triangular rigid piece having hinge 17 connecting the brace to the card support member; flange 18, shown in FIG. 3, attaches the hinge to the brace. A flat foot 25 on the brace abuts the floor of the container when the brace is in extended position, thereby supporting the card support member at the desired angle. The brace may be folded flat against the rear surface of the card support member as is shown in FIG. 4. The container may then be folded for storage or transportation by folding support member 7 forwardly, and then folding support member 8 rearwardly over the top of member 7. The brace is then folded flat, and the container assumes the configuration shown in FIG. 4. The container can then easily be transported or stored, e.g. by stacking, until the next usage.

Figure 2:
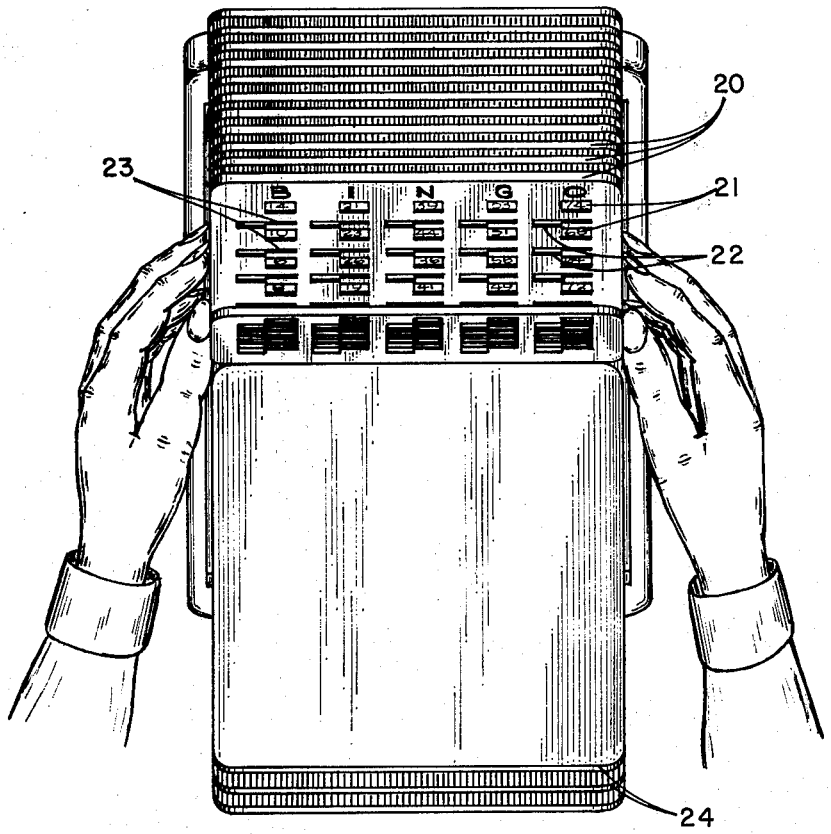
FIG. 2 is a top view of the container showing use of the device with the bingo cards in place.

Use of the device of the invention is shown in FIG. 2. A plurality of bingo cards 20 having substantially identical configuration are stacked in parallel front-to-back alignment in the container. Each card has a series of vertically arranged windows 21 in which varying numbers appear. Each window may be covered by a shade, indicating that the number in the window has been selected, by moving a tab 22 along a slot 23. The shade may be opaque, or may be transparent and colored to permit checking chosen numbers at the end of the game without withdrawing the shade. After the card has been checked by the player, it is flipped forwardly toward the player where it comes to rest against front card support member 8.

In using the device, a player places a plurality of cards in the container leaning against the rear card support member 7. When a number is called, the player immediately knows in which vertical column of windows the number is located. He then fixes his eyes on the appropriate column, and begins flipping the cards one by one toward him in the manner shown in FIG. 2. Each column is scanned for the number which has been selected. When the selected number appears on one of the cards, the user quickly reaches in with either thumb and slides the tab 22 to the right to cover the number. At the same time, he scans the card to see if that particular number completed a sequence of five in a row, thereby denoting a winning card. Players who have become proficient at using the container of the invention have been able to successfully play in excess of 30 cards at a time, with an interval between numbers being called of as little as 20 seconds.

A number of variations in the card holder of the invention may be made within the scope of the invention. For example, the movable card support member may be maintained upright by any type of support means. A transverse barrier retained in grooves 13 and 14 may be extended across the container behind the member for support, or a rigid supporting rod which seats in bottom grooves 12 may be used. If desired, the rear card support member 7 may also be adjustable along the length of the container.

As shown in the drawings, the container is illustrated as increasing in height from front to back; this is primarily decorative, and the container may be of uniform height if desired.

The method of mounting the front support member may also be varied. Instead of having vertical grooves, a series of opening may exist through the side walls of the container at the level of legs 16, with the member being pivotally held by removable pins which extend through the openings and into corresponding recesses in the support member.

In addition, other modifications may be made within the scope and spirit of the invention, which relates to a bingo card holder having an adjustable card support member. Accordingly, the scope of the invention should not be considered limited to the specific embodiment described herein, but should be considered limited only by the following claims.

I claim:

1. A holder for a plurality of bingo cards comprises a container having a floor, side walls, front and rear walls, and an open top, said side walls having a height substantially less than bingo cards to be supported in the holder, first pivotally mounted card support means for retaining a plurality of cards in a position slanted toward the front wall comprising a flat plate extending from a central portion of the container floor upwardly toward and substantially above said front wall, second pivotally mounted card support means for retaining a plurality of cards in a position slanted toward the rear wall comprising a flat plate extending from a central portion of the container floor upwardly toward and substantially above said rear wall, adjustment means for selectively varying the distance between the first and second card support means, a plurality of parallel grooves across the entire width of the holder for preventing slippage of bingo cards, and wherein the first and second card support means fold inwardly adjacent the container floor when the holder is not in use.

2. The holder of claim 1 wherein the first and second card support means each comprise a rigid flat member pivotally mounted in said side walls transverse to the container.

3. The holder of claim 1 wherein the grooves are spaced about 0.5 inches apart.

* * * * *